US007883755B2

(12) United States Patent
Lemberger

(10) Patent No.: US 7,883,755 B2
(45) Date of Patent: Feb. 8, 2011

(54) DIE CUT SHEET PRODUCT FOR FORMING SEPARABLE, INTERLOCKING NAPKIN BANDS

(75) Inventor: Mark S. Lemberger, Elm Grove, WI (US)

(73) Assignee: Western States Envelope Company, Butler, WI (US)

( * ) Notice: Subject to any disclaimer, the term of this patent is extended or adjusted under 35 U.S.C. 154(b) by 364 days.

(21) Appl. No.: 12/119,813

(22) Filed: May 13, 2008

(65) Prior Publication Data

US 2009/0286034 A1 Nov. 19, 2009

(51) Int. Cl.
*B32B 3/10* (2006.01)

(52) U.S. Cl. ..... 428/43; 428/136

(58) Field of Classification Search ..... 428/43, 428/136; 40/665; D7/633
See application file for complete search history.

(56) References Cited

U.S. PATENT DOCUMENTS 1,053,126 A * 2/1913 Fuller ..... 248/440.1
1,215,316 A * 2/1917 Benjamin ..... 206/232
5,853,837 A 12/1998 Popat
5,993,928 A 11/1999 Popat
5,997,680 A * 12/1999 Popat ..... 156/252
6,294,237 B1 9/2001 Popat
6,549,298 B1 4/2003 Sieber et al.
6,605,346 B2 8/2003 Mulvey et al.
D496,860 S * 10/2004 Mametja ..... D1/105
6,989,912 B2 1/2006 Sieber et al.
2005/0166548 A1 8/2005 Lavi
2005/0252057 A1 11/2005 Lavi

* cited by examiner

*Primary Examiner*—Alexander Thomas
(74) *Attorney, Agent, or Firm*—Andrus, Sceales, Starke & Sawall, LLP

(57) ABSTRACT

A product is provided for forming separable interlocking napkin bands. The product includes a sheet having a plurality of die cut lines extending along a length and a width of the sheet, and a plurality of slits extending from certain of the die cut lines. The die cut lines define a plurality of separable napkin bands that can be separated from one another along the die cut lines, and individually secured into a cylindrical formation by interlocking the slits together. The sheet is adapted to be passed through a printer and desired information is printed on the napkin bands, after which the napkin bands can be separated from one another.

14 Claims, 2 Drawing Sheets

DIE CUT SHEET PRODUCT FOR FORMING SEPARABLE, INTERLOCKING NAPKIN BANDS

FIELD OF THE INVENTION

The present invention relates to a die cut sheet product formed with a plurality of separable interlocking napkin bands which may include printed matter thereon.

BACKGROUND OF THE INVENTION

Napkin bands are commonly used to secure a napkin around silverware or eating utensils. The napkin bands are typically elongated strips of paper with an adhesive at one or both ends. Napkin bands are known to be manufactured in a variety of colors and some include printed content such as logos, names, etc. on a surface of the bands. The napkin bands typically have a first attachment area at a first end configured to overlap and connect adhesively face-to-face to a second attachment area on a second end to secure the band in a cylindrical formation wrapped around the napkin. Such napkin bands are provided on a continuous strip for separation therefrom and can be dispensed from a cartridge, and then wrapped manually or by machine around a napkin.

Other napkin bands are known that are supplied pre-cut into their individual size and stacked one on top of the other into a brick product. Before being used, the band must be peeled from the stack which requires more effort than desired.

Because of the costs and certain inconveniences associated with the construction and formation of existing napkin bands such as described as above, it is desirable to provide an improved product for forming a plurality of napkin bands in which the bands are separated from a die cut sheet, and secured in different cylindrical formations by interlocking the opposite ends thereof. It is also desirable to pass the die cut sheet of napkin bands through a printer before separation occurs.

SUMMARY OF THE INVENTION

The present invention relates broadly to a product for forming a plurality of separable interlocking bands. The product includes a sheet having a plurality of separation lines extending across the sheet and a plurality of slits extending from the separation lines to define a plurality of bands that can be separated from each other along the separation lines and each individually secured into a cylindrical formation by interlocking the slits together.

In a preferred aspect of the invention, the product includes a sheet having a plurality of die cut lines extending along a length and a width of the sheet. The sheet further includes a plurality of slits extending from certain of the die cut lines wherein the die cut lines define a plurality of separable napkin bands that can be separated from one another along the die cut lines, and individually secured into a cylindrical formation by interlocking the slits together.

In the preferred embodiment, the sheet is constructed from a flexible card stock paper material. The plurality of die cut lines includes a first set of die cut lines extending lengthwise across the sheet, and a second set of die cut lines extending widthwise and transversely across the first set of die cut lines. The first set of die cut lines extend parallel to each other and to opposite edges running lengthwise of the sheet. The second set of die cut lines is formed by single die cut line bisecting the sheet and forming a center line extending widthwise thereof. Certain of the slits extend from the first set of die cut lines and are spaced from opposite edges of the sheet extending widthwise thereof, and other of the slits extend from the first set of die cut lines and are spaced from the second set of die cut lines. Certain of the slits are spaced equally from the opposite edges of the sheet extending widthwise thereof, and other of the slits are spaced equally from the second set of die cut lines. An uppermost and a lowermost of the first set of die cut lines and the opposite edges running lengthwise and widthwise of the sheet define disposable waste strips.

The sheet is adapted to be passed through a printer and desired information is printed on the napkin bands after which the napkin bands can be separated from one another. The individually separated napkin bands are formed into secured cylindrical formation by interlocking the slits together such that the opposed ends of the napkin bands are either exposed or concealed. Each of the napkin bands preferably has a rectangular shape, and is adapted to be printed on at least an inner surface or outer surface thereof.

In another aspect of the invention, a product is provided for passing through a printer and separating out into individual printed interlocking bands. The product includes a sheet having a length and a width with the sheet having a first set of die cut lines extending lengthwise and partially through the sheet, and a second set of die cut lines extending widthwise and partially through the sheet and transversely across the first set of die cut lines. The sheet also includes a plurality of slits formed completely through the sheet and extending from the first set of die cut lines wherein the die cut lines define a plurality of separable bands that can be separated from one another along the die cut lines and individually secured into a cylindrical formation by interlocking the slits together. The sheet is adapted to be passed through a printer and desired printed matter can be printed on at least a top surface or a bottom surface of the bands on the sheet after which the bands can be separated from one another.

The first set of die cut lines are spaced parallel to one another, and the slits extend transversely to the first set of die cut lines. The second set of die cut lines is a single center line bisecting the sheet and the slits extend parallel to the center line.

Various other features, objects and advantages of the invention will be made apparent from the following description taken together with the drawings.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
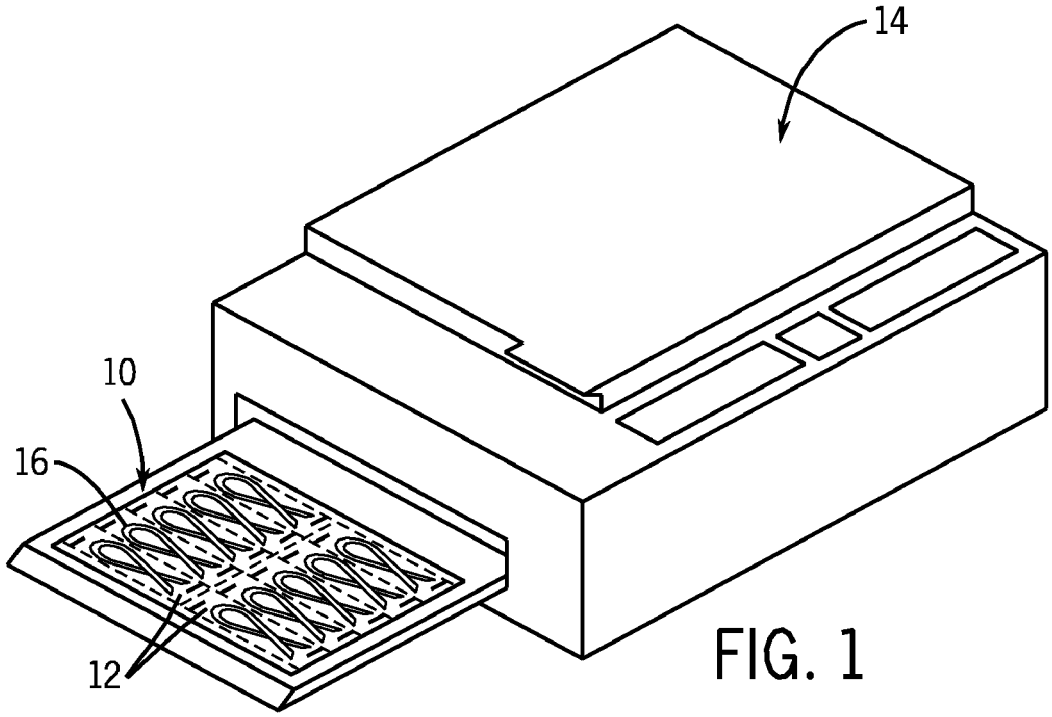
FIG. 1 is a perspective view of a laser printer for printing a die cut sheet having a plurality of separable interlocking napkin bands embodying the present invention.
Figure 2:
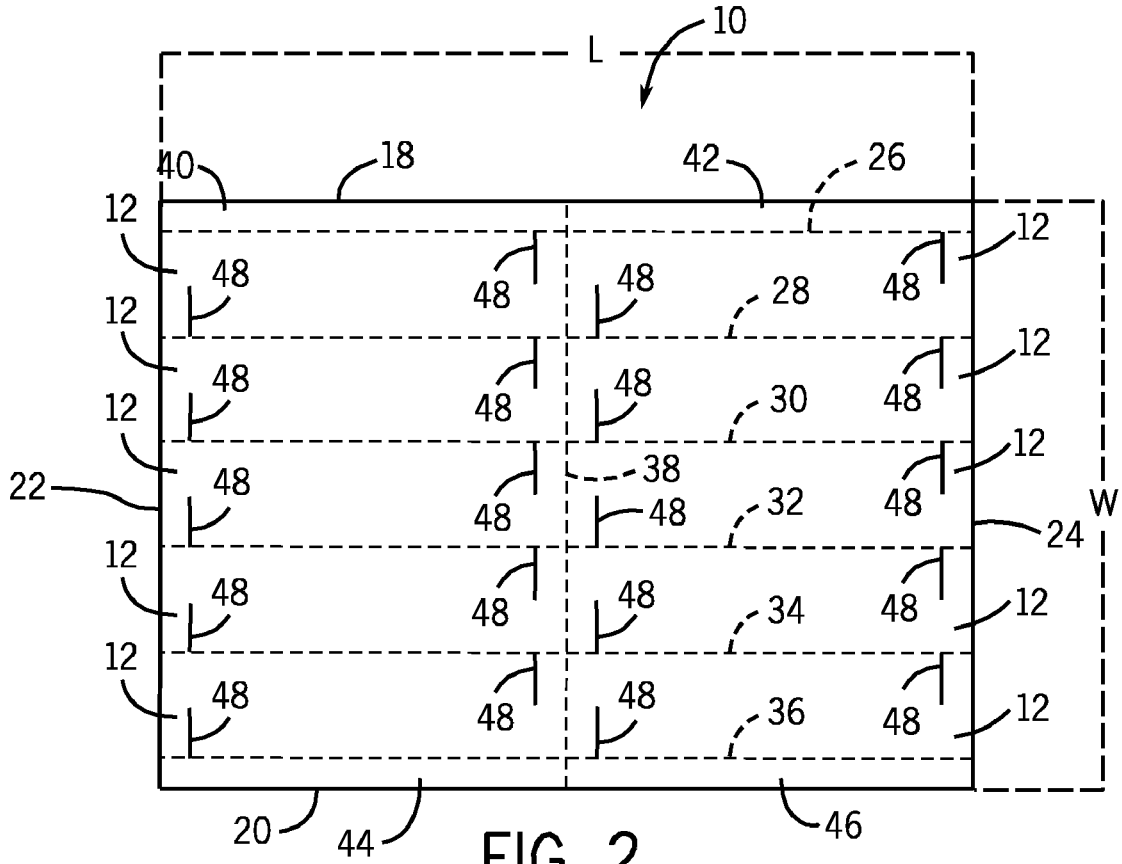
FIG. 2 is a plan view of a blank die cut sheet of napkin bands.
Figure 3:
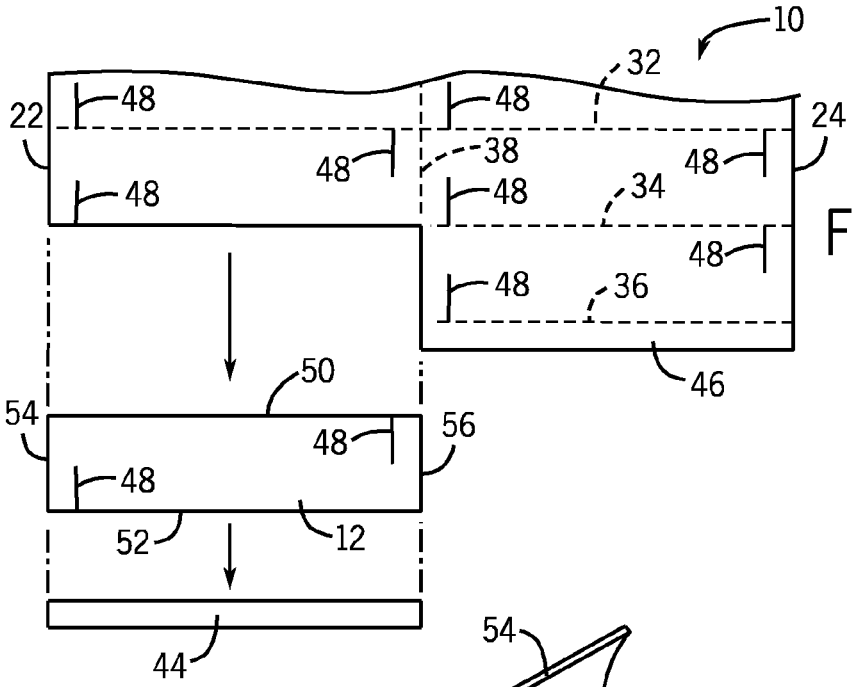
FIG. 3 is a fragmentary view of FIG. 2 depicting the separation of one of the napkin bands.

Referring now to FIGS. 1-3, the present invention is embodied in a die cut sheet 10 containing a plurality of separable interlocking napkin bands 12 which are conventionally used to secure a napkin wrapped around silverware or eating utensils.

The die cut sheet 10 may be fed into a variety of printers or photocopiers. Such printers include those typically used in the home or office, such as the laser printer 14 shown in FIG. 1, a color laserjet, laserjet, inkjet, bubblejet or thermal transfer. The types of printers and photocopiers that may be used, however, are not limited to those listed above. The printer 14 is used to print various decorations, designs, advertisements, useful information or other printed matter 16 upon at least a top surface or bottom surface of the die cut sheet 10. After the die cut sheet 10 is printed, individual napkin bands 12 may be separated from the sheet 10, and manipulated to interlock opposite ends together as depicted in FIGS. 3-6.

As seen in FIG. 2, the die cut sheet 10 is flat and formed of a fairly heavy paper or light cardboard stock that is laser printer compatible flexible and tear resistant. In the preferred embodiment, the die cut sheet 10 is generally rectangular having pairs of opposed side edge 18, 20 extending along a length and opposed side edges 22, 24 extending along a width.

The napkin bands 12 are defined by a series of six longitudinally extending die cut lines 26, 28, 30, 32, 34, 36 that are spaced equidistantly from each other, and extend lengthwise between edges 22 and 24. Die cut lines 26 and 36 are spaced slightly inwardly at equal distances from longitudinal edges 18 and 20, respectively. The sheet 10 is bisected along a center line by a die cut line 38 which extends transversely and widthwise across each of the other die cut lines 26, 28, 30, 32, 34, 36 between edges 18 and 20. Die cut line 38 runs parallel to edges 22 and 24.

In the embodiment shown, the die cut lines 26, 28, 30, 32, 36 and 38 form a "ten-up" configuration often adjacently connected napkin bands 12 and four waste strips 40, 42, 44 and 46. It should be understood that the term die cut lines consist of lines of weakness or microperforations extending substantially through the thickness of the sheet which permit easy folding and cleanly separating, tearing or pulling apart material without leaving coarse irregularities following separation.

The die cut sheet 10 is also formed completely therethrough with a plurality of slits 48 which are used to join opposite ends of each napkin band 12 in interlocked securement. A pair of spaced apart slits 48 extend transversely from each of the die cut lines 26, 28, 30, 32, 34 and 36. All of the slits 48 run parallel relative to the sheet edges 22 and 24 and the center line die cut line 38. Certain of the slits 48 are located adjacent and equally spaced from the center line die cut line 38, and the remainder of the slits 48 lie adjacent and equally spaced from the sheet edges 22 and 24. As seen in FIG. 2, the slits 48 lie in four aligned groups on the die cut sheet 10.

In use, the die cut sheet 10 shown in FIG. 2 is fed into printer 14, and printed on a top surface and/or a bottom surface of sheet 10 with the desired printed matter 16. Once printing is done a user typically bends and removes a waste strip 44 and one of the napkin bands 12 from the printed die cut sheet 12 as shown in FIG. 3.

Figure 4:
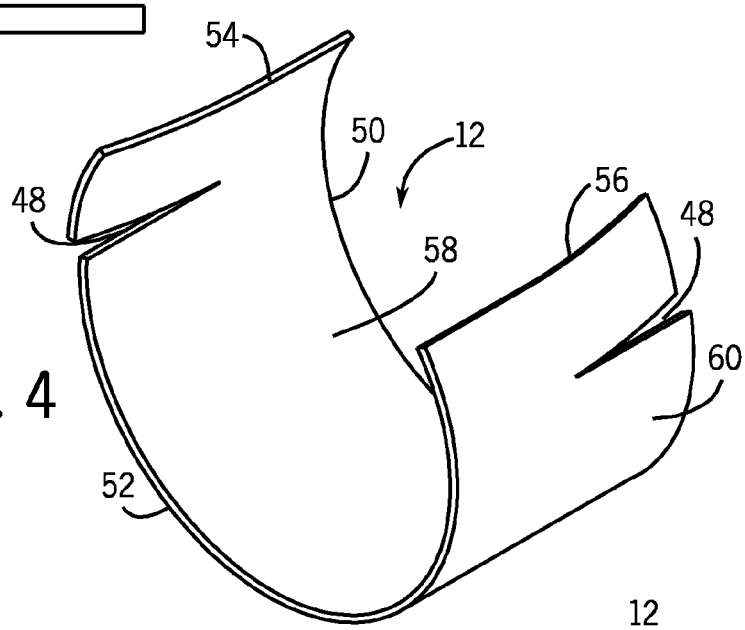
FIG. 4 is a perspective view illustrating an initial bending of a separated napkin band prior to interlocking the opposite ends thereof.
Figure 5:
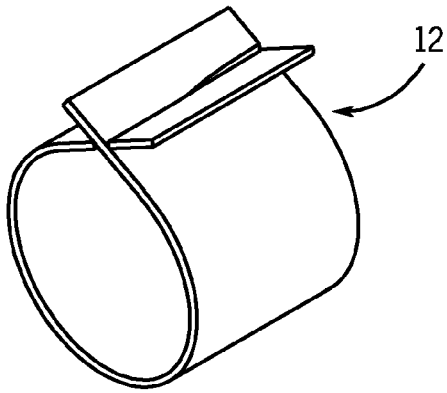
FIG. 5 shows one embodiment of a fully secured napkin band with opposite ends interlocked.
Figure 6:
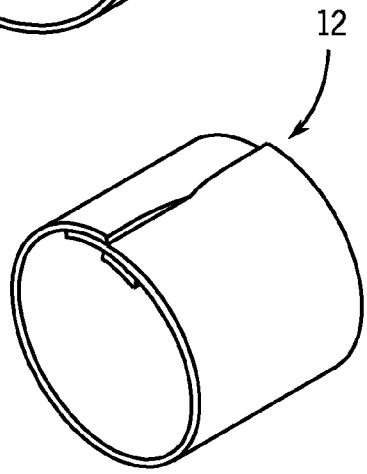
FIG. 6 shows another embodiment of a fully secured napkin band with opposite ends interlocked.

In the preferred embodiment, each napkin band 12 is rectangular and has opposed longitudinal edges 50, 52 and opposed ends 54, 56 defined by the die cut lines 26, 28, 30, 32, 34, 36, and 38 and edges 22 and 24. Each napkin band 12 also has a top or inner surface 58 and a bottom or outer surface 60, either or both of which may be printed. Each napkin band 12 has a first slit 48 that extends transversely and inwardly from one edge 52 near one end 54, and a second slit 48 that extends transversely and inwardly from the opposite edge 50 near the other end 56. Once each napkin band 12 is separated from the die cut sheet 10, a user bends the band 12 to bring the ends 54, 56 toward each other as shown in FIG. 4. The napkin band 12 is then conventionally formed into a cylindrical formation by interlocking the slits 48 together. FIG. 5 shows one version of secured napkin band 12 wherein the opposed ends 54, 56 are exposed. FIG. 6 shows another version of secured napkin band 12 wherein the opposed ends 54, 56 are overlapped and concealed.

Each napkin band 12 on die cut sheet 10 is similarly removed and formed, after which the waste strips 40, 42, 44, 46 are deposed of.

As set forth above, the creation of each napkin band 12 is relatively easy. The napkin band 12 is inexpensive and can be printed on either the inner surface 58 or outer surface 60 or both surfaces, if desired. For example, a napkin band 12 may be placed next to a diner with the diner's name printed thereon. Alternatively, the napkin band 12 can be printed with logos, graphics, photos and various text information. The opposite ends 54, 56 of the napkin band 12 can be detached to allow access to a hidden printed inner surface 58 which lends itself to use of the band 12 for games of chance, riddles, trivia and other surprises.

It should be understood that the present invention thus provides a convenient, inexpensive die cut sheet design for providing a series of separable interlocking napkin bands 12 that may be variously printed and easily used. The die cut sheet 10 may be of any size accommodated by a printer or photo copier. Likewise, the napkin bands 12 may have different shapes and sizes.

While the present invention has been described preferably for forming a series of napkin bands, it should be appreciated that the invention contemplates a sheet of die cut lines and slits for forming a single interlocking napkin band. More broadly, the die cut sheet may have a plurality of die cut lines and slits for forming one or more interlocking bands which might be used to wrap around another object other than napkins, such as a drinking container.

Various alternatives and embodiments are contemplated as being within the scope of the following claims particularly pointing out distinctly claiming the subject matter regarded as the invention.

I claim:

1. A napkin band blank product for forming a plurality of separable interlocking napkin bands comprising:

a sheet having a plurality of die cut lines extending along a sheet length defined by a first pair of opposed side edges and a sheet width defined by a second pair of opposed side edges, and a plurality of slits extending from certain of the die cut lines wherein the die cut lines define a plurality of separable interlocking napkin bands that are detachable from one another along the die cut lines and individually securable into a cylindrical formation by interlocking the slits together, wherein the plurality of die cut lines includes a first set of die cut lines extending lengthwise across the sheet and spaced from the first pair of opposed side edges, and a second set of die cut lines extending widthwise and transversely across the first set of die cut lines, the second set of die cut lines being formed by a single die cut line bisecting the sheet and defining a center line, and wherein the slits are formed exclusively between the first set of die cut lines such that the opposed side edges are continuous and uninterrupted.

2. The product of claim 1, wherein the first set of die cut lines extend parallel to each other and to the first pair of opposed side edges.

3. The product of claim 2, wherein an uppermost and a lowermost of the first set of die cut lines and the first and second pairs of opposed side edges define disposable waste strips.

4. The product of claim 1, wherein certain of the slits extend from the first set of die cut lines and are spaced equally from the second pair of opposed side edges, and other of the slits extend from the first set of die cut lines and are spaced equally from the single die cut line.

5. The product of claim 1, wherein the sheet is adapted to be passed through a printer and desired information is printed on the napkin bands after which the napkin bands can be separated from one another.

6. The product of claim 1 wherein each of the napkin bands has a rectangular shape.

7. The product of claim 1, wherein the sheet is adapted to be printed on at least an inner surface or outer surface thereof

8. A band forming product for passing through a printer and separating out into a plurality of individual printed interlocking bands comprising:

a sheet having a length defined by a first pair of opposed side edges and a width defined by a second pair of opposed side edges, the sheet having a set of die cut lines extending lengthwise and partially through the sheet and spaced from the first pair of opposed edges, a single die cut center line bisecting the sheet and extending widthwise and partially through the sheet and transversely across the set of die cut lines, and a plurality of slits formed completely through the sheet and extending from the set of die cut lines wherein the die cut lines define a plurality of separable bands that are detachable from one another along the die cut lines and individually securable into a cylindrical formation by interlocking the slits together; and wherein the sheet is provided with desired printed matter on at least a top surface or a bottom surface of the sheet, wherein the slits are formed exclusively between the set of die cut lines such that the opposed side edges are continuous and uninterrupted, and wherein certain of the slits are spaced equidistantly from the single die center line.

9. The product of claim 8, wherein the set of die cut lines is spaced parallel to one another.

10. The product of claim 8, wherein the slits extend transversely to the set of die cut lines.

11. The product of claim 10, wherein the slits extend parallel to the center line.

12. A method of producing printed interlocking band forming products as set forth in claim 8 comprising the steps of:

a) passing the sheet through the printer to form at least a printed top surface or bottom surface of the sheet;

b) detaching the bands from one another along the die cut lines, such that each separated band has opposed ends provided with the slits; and c) securing each separated band into a substantially cylindrical formation by interlocking the slits at opposed ends together.

13. The method of claim 12, wherein, in step c), the opposed interlocked ends are exposed outside an outer surface of each separated band.

14. The method of claim 12, wherein, in step c), the opposed interlocked ends are concealed inside an outer surface of each separated band.

* * * * *